US005620347A

United States Patent [19]

Sawada

[11] Patent Number: 5,620,347

[45] Date of Patent: Apr. 15, 1997

[54] CONTACT PORTION STRUCTURE OF FEMALE CONNECTOR TERMINAL

[75] Inventor: Yoshitsugu Sawada, Shizuoka-ken, Japan

[73] Assignee: Yazaki Corporation, Tokyo, Japan

[21] Appl. No.: 496,474

[22] Filed: Jun. 29, 1995

[30] Foreign Application Priority Data

Jun. 30, 1994 [JP] Japan ..... 6-149313

[51] Int. Cl.[6] ..... H01R 11/22

[52] U.S. Cl. ..... 439/851; 439/856

[58] Field of Search ..... 439/842, 851–857, 439/861

[56] References Cited

U.S. PATENT DOCUMENTS

| | | | |
|---|---|---|---|
| 4,772,234 | 9/1988 | Cooper | 439/851 |
| 5,106,329 | 4/1992 | Maeshima et al. | 439/851 |
| 5,135,418 | 8/1992 | Hatagishi et al. | 439/851 |

FOREIGN PATENT DOCUMENTS

| | | |
|---|---|---|
| 53-96190 | 8/1978 | Japan . |
| 3-118572 | 12/1991 | Japan . |

*Primary Examiner*—David L. Pirlot
*Attorney, Agent, or Firm*—Finnegan, Henderson, Farabow, Garrett & Dunner, L.L.P.

[57] ABSTRACT

A contact portion structure of a female terminal (1) has a pair of opposing elastic plate portions (4), two pairs of flat plate-shaped contact portions (5) each pair extending from one of the opposing elastic plate portions (4) and bent at right angles at each end thereof, and contact projections (8) each formed on each inner surface of the flat plate-shaped contact portion (5) and brought into contact with a pin portion (7) of a mated male terminal (6). In particular, a diameter of the contact projections (8) is determined larger than a V-shaped groove (9) of the pin portion (7) of the mated male terminal (6). As a result, it is possible to prevent any contact projection (8) from entering the V-shaped junction groove (9) of the pin portion (7) of the male terminal (6), so that the two male and female terminals can be connected to each other stably without any eccentric contact. Further, since a pair of the elastic plate portions (4) are formed extending from one side of the square cylindrical portion (2), the female terminal can be formed at a high precision with a press machine.

6 Claims, 3 Drawing Sheets

CONTACT PORTION STRUCTURE OF FEMALE CONNECTOR TERMINAL

BACKGROUND OF THE INVENTION

1. Technical Field of the Invention

The present invention relates to a contact portion structure of a female connector terminal, and more specifically to a contact structure between a pair of flat plate-shaped contact portions of a female terminal and a contact pin of a male terminal.

2. Description of the Related Art

In general, a male terminal is formed with a hollow contact pin portion and a wire clamping portion. On the other hand, a female terminal is formed with a cylindrical portion electrically connected to the hollow contact pin portion of the male terminal and a wire clamping portion. The contact pin of the male terminal and the cylindrical portion of the female terminal are usually formed by rounding a thin metal plate from both the sides thereof so as to be joined at the central junction portion thereof, respectively. In this case, however, when the thin metal plate is bent into a cylindrical shape, since the outer diameter of the male terminal contact pin and the inner diameter of the female terminal cylindrical portion tend to disperse in dimension, there exists a problem in that the management of dimensions of these terminal parts is troublesome.

To overcome this problem, Japanese Published Unexamined Utility Model Application No. 3-118572 discloses such a female terminal that an end of the female terminal is formed by flat plate-shaped contact portions. In more detail, a cylindrical elastic portion of the female terminal is formed by rounding a thin metal plate, and upper and lower slits are formed along the longitudinal direction of the female terminal at the cylindrical elastic portion. Further, at the end of the cylindrical elastic portion, two pairs of flat plate-shaped contact portions (four in total) are formed along the circumference of the free end of the female terminal, as electric contact portion with the male connector inserted into the cylindrical elastic portion of the female terminal. In this female terminal, additionally a contact projection is formed at each inner surface of the flat plate-shaped contact portions to increase the contact reliability between the male and female terminals. In the above-mentioned female terminal, since two pairs of the flat plate-shaped contact portions each pair formed via a circular arc-shaped bent portion are formed on both sides of the slits, respectively; in other words, since the electric contact portions of the female terminal are formed being bent into flat shape, it is possible to improve the manufacturing precision of the space dimension between the two opposing flat plate-shaped contract portions, because the female terminal can be bent by use of an appropriate press machine.

When the male terminal pin is inserted into a roughly square hollow portion enclosed by the flat plate-shaped contact portions of the female terminal, since the contact projections formed in the flat plate-shaped contract portions of the female terminal, respectively can be firmly brought into contact with the outer circumferential surface of the pin portion of the male terminal, a stable electrical contact can be attained.

In the conventional female terminal, however, when one of the contact projections formed in the flat plate-shaped contact portions of the female terminal drops into a V-shaped groove formed at the junction portion between the two ends of the rounded thin metal plate of the male terminal, since the male and female terminals are connected to each other in eccentric state, there exists a problem in that the electric contact reliability deteriorates.

SUMMARY OF THE INVENTION

With these problems in mind, therefore, it is the object of the present invention to provide a contact portion structure of a female terminal, which can prevent the contact projections formed in the flat plate-shaped contact portions of the female terminal from dropping into a V-shaped groove formed at the junction portion between the two ends of the rounded thin metal plate of the male terminal, so that a stable concentric contact can be obtained between the male and female terminals.

To achieve the above-mentioned object, the present invention provides a contact portion structure of a female terminal (1) having a pair of opposing elastic plate portions (4), two pairs of flat plate-shaped contact portions (5) each pair extending from one of the opposing elastic plate portions, respectively and bent at right angles at each end thereof, and contact projections (8) each formed on an inner surface of the flat plate-shaped contact portion (5) and brought into contact with a pin portion (7) of a mated male terminal (6), wherein a diameter of each of the contact projections (8) is determined larger than a V-shaped junction groove (9) of a pin portion (7) of a mated male terminal (6).

Further, it is preferable that the female terminal (1) is formed with a square cylindrical portion (2), and a pair of the opposing elastic plate portions (4) are formed extending from one side of the square cylindrical portion (2) extending from a wire clamping portion (15) of the female connector.

Further, it is preferable that each of the flat plate-shaped contact portion (5) is formed with a taper guide portion (14) at the distal end of the flat plate-shaped contact portion.

In the contact portion structure of the female terminal according to the present invention, since the diameter of the contact projections formed in inner surfaces of the respective flat prate-shaped contract portions of the female terminal is determined larger than the width of the V-shaped junction groove formed in the contact pin portion of the male terminal, even if any one of the contact projections of the female terminal is positioned at the V-shaped junction groove of the male terminal, it is possible to prevent the contact projection from entering the V-shaped junction groove, that is, the male terminal from being mated with the female terminal eccentrically, with the result that the male and female terminals can be mated tinder a stable contact pressure reliably and thereby the electric contact reliability between the two mated terminals can be improved.

Further, since the pair of the elastic plate portions are formed extending from the square cylindrical portion of the female terminal, the female terminal can be formed by a press machine at high precision, as compared with the conventional female terminal.

Further, since the flat plate-shaped contact portion (5) is formed with a taper guide portion (14), the pin portion of the male terminal can be smoothly mated with the female terminal.

DETAILED DESCRIPTION OF THE EMBODIMENTS

An embodiment of the contact portion structure of a female terminal according to the present invention will be described hereinbelow with reference to the attached drawings.

Figure 1:
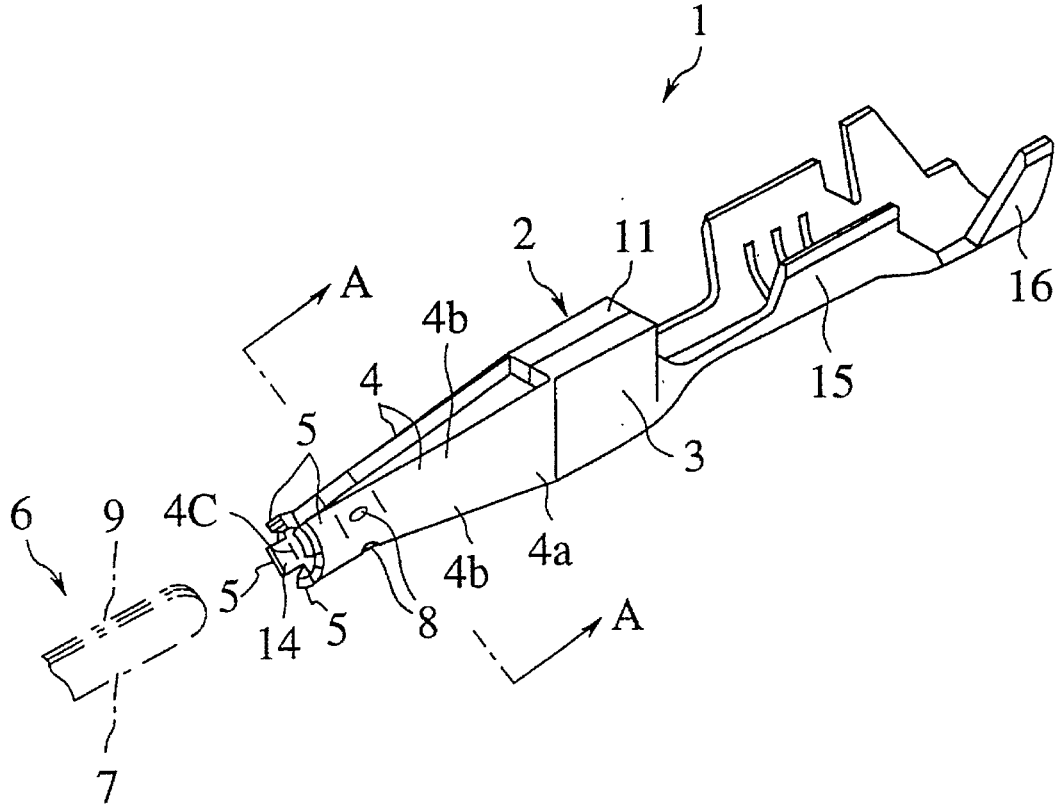
FIG. 1 is a perspective view showing an embodiment of the female terminal according to the present invention.
Figure 2:
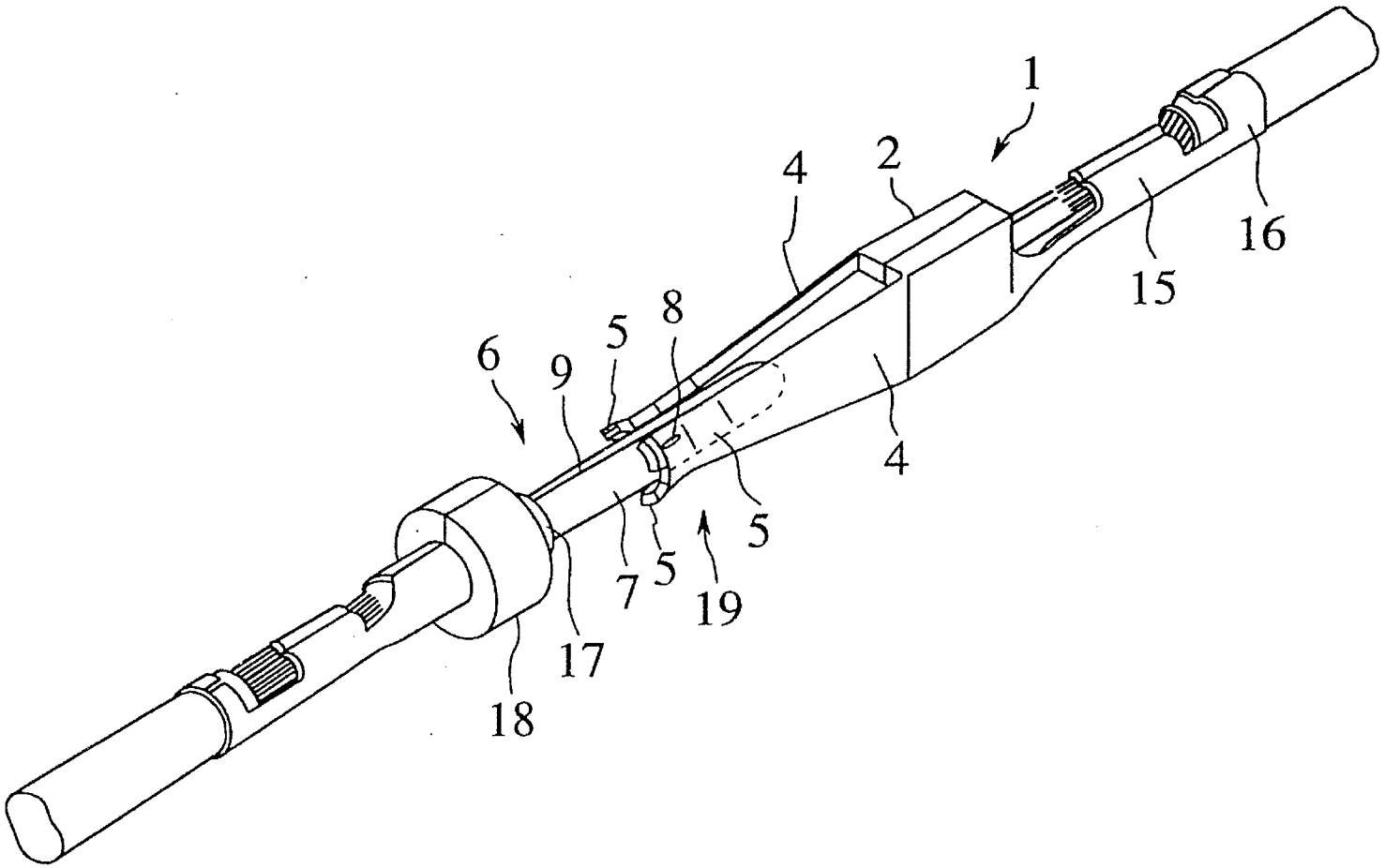
FIG. 2 is a perspective view showing the male and female terminals mated to each other.

In FIGS. 1 and 2, a female terminal 1 is composed of a square cylindrical portion 2 extending from an intermediate portion of the female terminal 1, a pair of elastic plate portions 4 extending from both side walls 3 of the square cylindrical portion 2, a pair of flat plate-shaped contact portions 5 extending from both ends of the elastic plate portions 4, and four tapered guide portions 14 extending from both ends of the flat plate-shaped contact portions 5. Here, the feature of the contact portion structure of a female terminal according to the present invention is to from some contact projections 8 on an inner surface of each of the flat plate-shaped contact portions 5 in such a way that the diameter of each contact projection 8 is larger than a width S (shown in FIG. 5) of a V-shaped groove 9 at the junction portion inevitably formed when a thin metal plate is rounded to form a circular male terminal 7.

Figure 3:
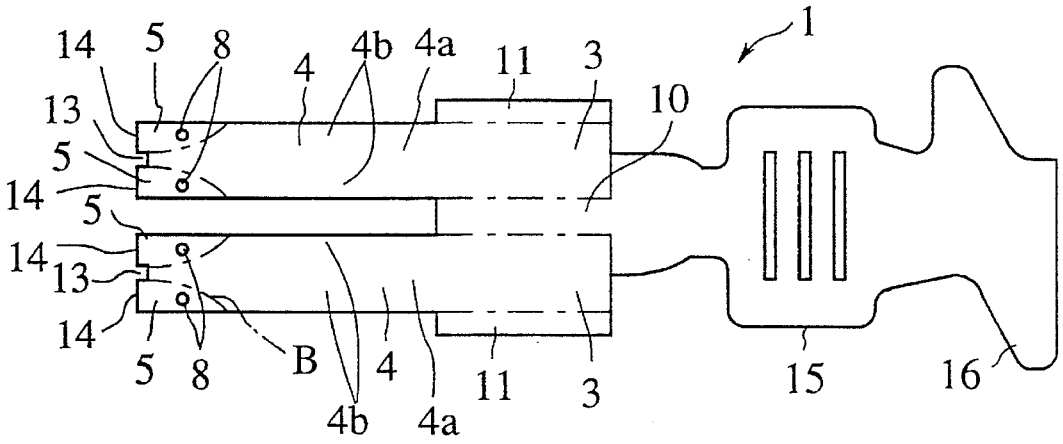
FIG. 3 is a development view showing the same female terminal shown in FIG. 1.

In more detail, with reference to FIG. 3 (development view), the square cylindrical portion 2 is formed by bending two side walls 3 from a bottom wall 10 of the female terminal 1 and further bending each junction piece 11 inward from each upper end of the side walls 3 so as to be opposed to each other. In the conventional female terminal, the portion corresponding to this square cylindrical portion 2 is formed into a circular cylindrical shape, so that it has been relatively difficult to form this portion at a high manufacturing precision. In contrast with this, the square cylindrical portion 2 of the female terminal 1 according to the present invention can be formed easily at a relatively high manufacturing precision with a press machine.

Figure 4:
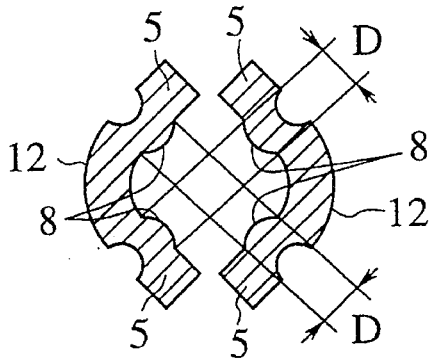
FIG. 4 is an enlarged cross-sectional view taken along the line A—A in FIG. 1.
Figure 5:
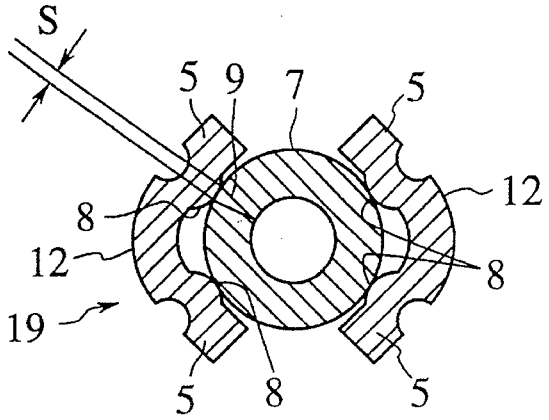
FIG. 5 is an enlarged cross-section view showing the state in which the pin portion of the male terminal is inserted into the flat plate-shaped contact portions of the female terminal.

As shown in FIG. 1, a pair of the elastic plate-shaped portions 4 are formed each by forming the base end side 4*a* thereof into a flat shape, by gradually bending the upper and lower end sides 4*b* thereof inward with increasing distance from the base end side 4*a* to the free end side thereof, and by bending the free end 4*c* thereof into two opposing flat plate-shape portions 5 via a circular arc-shaped bent portion 12 (as shown in FIG. 4). In more detail, a pair of the flat plate-shape portions 5 are formed on both sides of the circular arc-shaped bent portion 12, and further two pairs of the flat plate-shaped portions 5 are opposed to each other at right angles at two opposing sides thereof, in the same way as with the case of the conventional female terminal, as shown in FIG. 4. Further, each contact projection 8 is formed in each inward surface of each flat plate-shaped contact portion 5 of the female terminal 1 so that four contact projections 8 can be brought into tight contact with a pin portion 7 of the male terminal 6, as shown in FIG. 5. Each contact projection 8 is formed by pushing each flat plate-shaped contact portion 5 inward into a semispherical shape in such a way that the diameter D of each semispherical shape (shown in FIG. 4) is larger than a maximum width S of a V-shaped groove V. The V-shaped groove 9 is inevitably formed at the junction portion when a thin metal plate is rounded into a cylindrical shape as the pin portion 7 of the male terminal 6, as already explained.

As a result, as shown in FIG. 5, even if any contact projection 8 of the female terminal 1 is positioned at the V-shaped junction groove 9 of the pin portion 7 of the male terminal 6, since the contact projection 8 will not enter the V-shaped junction groove 9, it is possible to prevent a pair of the flat plate-shaped contact portions 5 from being located eccentric from the pin portion 7 of the male terminal 6 at the electric contact portion 19 of the male and female terminals 6 and 1, as shown in FIG. 2. In other words, since the respective inner contact projections 8 can be brought into contact with the outer surface of the pin portion 7 of the male terminal 6 under uniform spring forces of a pair of the elastic plate portions 4 generated when the female terminal 1 is widened radially outward by the male terminal 6 mated thereinto.

Further, in FIG. 3, the flat plate-shaped contact portions 5 are formed being arranged at regular angular intervals at the ends of the two elastic plate portions 4, by bending the end portions thereof as shown by dot-dashed lines in FIG. 3. Further, a pair of cutout portions 13 are formed between a pair of the flat plate-shaped contact portions 5, and two pairs of taper guide portions 14 (as shown in FIG. 1) are formed by bending the free ends of the flat plate-shaped contact portions 5 being bent beginning from the cutout portions 13, respectively, so that the pin portion 7 of the male terminal 6 can be smoothly mated with the female terminal 1. Further, in FIG. 1, the female terminal 1 is formed with a wire clamping portion 15 and a wire cover clamping portion 16. Further, in FIG. 2, the male terminal 6 is provided with a stopper 18 having a conical portion 17 fitted to the taper guide portion 14 of the female terminal 1 to prevent the male terminal 6 from being inserted into the female terminal 1 excessively.

As described above, in the contact portion structure of the female terminal according to the present invention, since the diameter of the contact projections formed in inner surfaces of the respective flat plate-shaped contract portions of the female terminal is determined larger than the width of the V-shaped junction groove formed in the contact pin portion of the male terminal, even if any one of the contact projections of the female terminal is positioned at the V-shaped junction groove of the male terminal, it is possible to prevent the contact projection from entering the V-shaped junction groove, that is, the male terminal from being mated with the female terminal eccentrically, with the result that the male and female terminals can be mated under a stable contact pressure reliably and thereby the electric contact reliability between the two mated terminals can be improved. Further, since the a pair of the elastic plate portions are formed extending from the square cylindrical portion of the female terminal, the female terminal can be formed by a press machine at high precision, as compared with the conventional female terminal.

What is claimed is:

1. A contact portion structure of a female terminal (1) for receiving a pin portion of a mated male terminal, the pin portion having a junction groove, the contact portion structure comprising:

a pair of opposing elastic plate portions (4);

two pairs of flat plate-shaped contact portions (5), each pair extending from one of the opposing elastic plate portions, respectively and bent at right angles at each end thereof; and contact projections (8) having a diameter, each contact projection being formed on an inner surface of the flat plate-shaped contact portion (5) for contacting the pin portion (7) of the mated male terminal (6), the diameter of each of the contact projections (8) being larger than the junction groove (9) of the pin portion (7) of the mated male terminal (6).

2. The contact portion structure of a female terminal of claim 1, further comprising a square cylindrical portion (2), the pair of opposing elastic plate portions (4) extending from one side of the square cylindrical portion (2) and a wire clamping portion (15) extending from an opposite side of the square cylindrical portion.

3. The contact portion structure of a female terminal of claim 1, wherein each of the flat plate-shaped contact portions (5) has a taper guide portion (14) at the distal end thereof.

4. An electrical socket contact for receiving a pin contact having a longitudinal groove comprising:

a body portion;

a pair of opposing elastic plate portions extending from a side of the body portion;

two pair of contact portions, each pair of contact portions extending from a free end of one of the opposing elastic plate portions, respectively; and contact projections having a diameter, each contact projection attaching to an inner surface of one of the pair of contact portions for receiving and contacting the pin contact, the diameter of the contact projections being larger than the longitudinal groove in the pin contact.

5. The socket contact of claim 4, wherein the body portion has an orthogonal cross-section.

6. The socket contact of claim 4, further comprising a wire clamping portion extending from an opposite side of the body portion.

* * * * *